US008534665B2

(12) United States Patent
Hsu

(10) Patent No.: US 8,534,665 B2
(45) Date of Patent: Sep. 17, 2013

(54) INPUT TRAY CAPABLE OF ALIGNING PAPER

(75) Inventor: Shao-Hung Hsu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/304,312

(22) Filed: Nov. 24, 2011

(65) Prior Publication Data

US 2013/0043649 A1 Feb. 21, 2013

(30) Foreign Application Priority Data

Aug. 15, 2011 (TW) ..... 100129138

(51) Int. Cl.
*B65H 1/00* (2006.01)

(52) U.S. Cl.
USPC ..... 271/171; 271/145; 271/3.14

(58) Field of Classification Search
USPC ..... 271/171, 145, 3.14; 399/377
See application file for complete search history.

(56) References Cited

FOREIGN PATENT DOCUMENTS

| | | | |
|---|---|---|---|
| JP | 59007634 A | * | 1/1984 |
| JP | 62116426 A | * | 5/1987 |
| JP | 04148733 A | * | 5/1992 |

* cited by examiner

*Primary Examiner* — Luis A Gonzalez
(74) *Attorney, Agent, or Firm* — Altis Law Group, Inc.

(57) ABSTRACT

A paper input tray includes a support plate for holding the sheets of paper, two latching members slidably connected to the support plate, a cover rotatably connected to the support plate, and a driving mechanism. Each latching member includes a latching plate. The cover is capable of being rotated open and rotated closed. When the cover is down in the closed position, the distance between the two latching plates is slightly less than that of the sheets. When the cover is rotated open, the two latching members are driven by the driving mechanism so as to increase the distance between the two latching plates.

14 Claims, 5 Drawing Sheets

INPUT TRAY CAPABLE OF ALIGNING PAPER

BACKGROUND

1. Technical Field

The present disclosure relates to input trays for holding sheets of paper, and particularly, to an input tray capable of automatically aligning the sheets.

2. Description of Related Art

Scanners and printers may include an input tray for holding a stack of paper sheets. Traditionally, the input tray includes a support plate and two latching members fixedly connected to the support plate for holding the sheets therebetween. A user must align the sheets before putting the sheets into the input tray. This takes time, and is inconvenient to the user.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
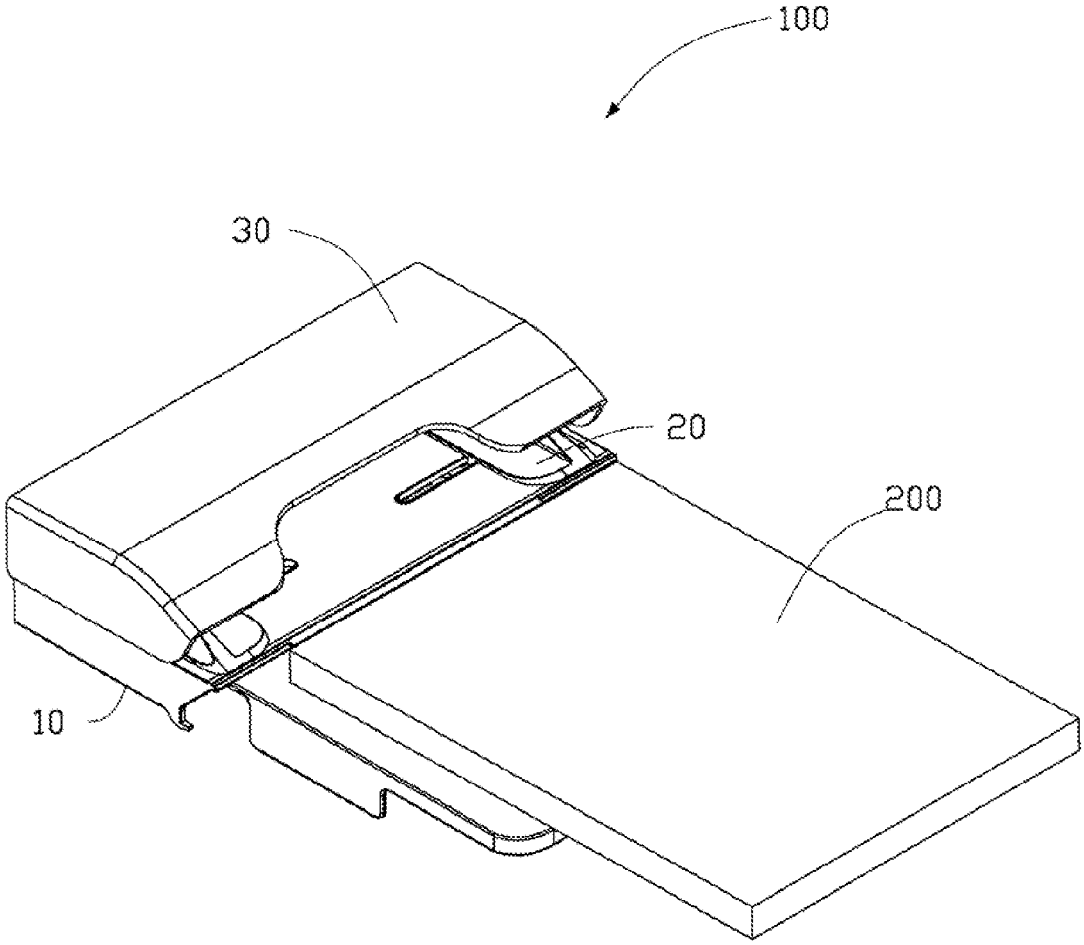
FIG. 1 is an isometric view of an input tray according to an exemplary embodiment, together with a stack of paper placed thereupon.
Figure 2:
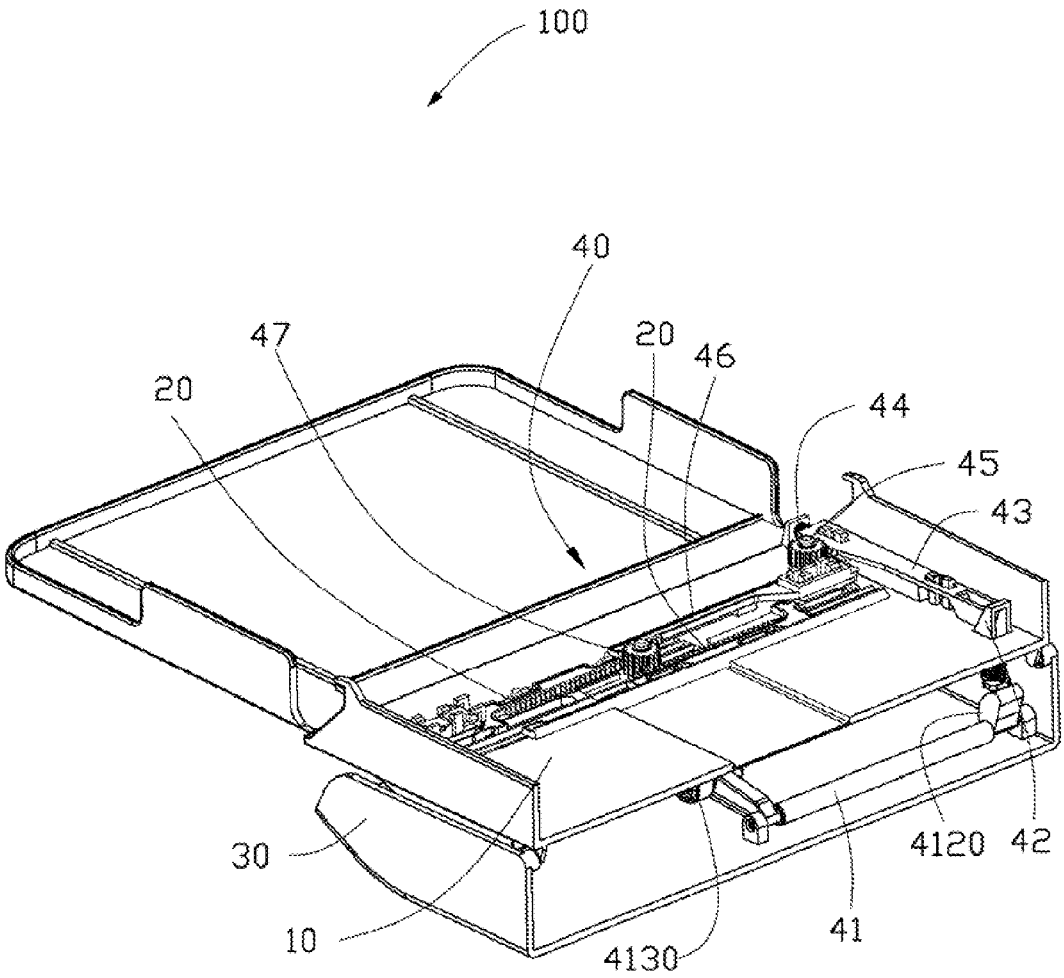
FIG. 2 is similar to FIG. 1, but viewed from the reverse perspective.

Embodiments of the present disclosure are described in detail, with reference to the accompanying drawings.

Referring to FIGS. 1-4, an input tray 100 for holding a stack of sheets 200 according to an exemplary embodiment is illustrated. The input tray 100 includes a support plate 10, two latching members 20 slidably connected to the support plate 10, a cover 30 rotatably connected to the support plate 10, and a driving mechanism 40 mounted on the support plate 10. The driving mechanism 40 is used to move the two latching members 20 towards or away from each other.

The support plate 10 defines two sliding slots 11 aligned with each other and a sliding hole 12 extending through the plate 10. The support plate 10 includes a bottom surface 16 facing away the cover 30. The bottom surface 16 includes a first positioning post 13, a second positioning post 14 between the two sliding slots 11, and a stopper block 15 protruding therefrom.

Each latching member 20 includes a latching plate 21, a first rack 22, and a connecting portion 24 connecting the latching plate 21 and the first rack 22. The connecting portion 24 extends through one sliding slot 11 of the support plate 10, allowing the latching member 20 to slide along the grooves 11. The first rack 22 includes a set of first teeth 23.

The cover 30 includes a base plate 31, two side plates 32 perpendicular to the base plate 31, and two protruding blocks 33 (one not shown). The side plates 32 are rotatably coupled to the support plate 10, allowing the cover 30 to be rotated to a closed position to cover a portion of the support plate 10 or an open position away from the support plate 10.

The driving mechanism 40 includes a detecting assembly 41 rotatably connected to the cover 30, a slider 42 slidably retained within the sliding hole 12, an elongated second rack 43 slidably connected to the bottom surface 16 of the support plate 10, a resilient member 44 applying a pushing force to the second rack 43, a first gear 45 rotatably sleeved on the first positioning post 13, an elongated third rack 46 slidably connected to the bottom surface 16, and a second gear 47 rotatably sleeved on the second positioning post 14. In the embodiment, the second rack 43 can slide in a direction perpendicular to the sliding direction of the first rack 22, and the third rack 46 can slide in a direction parallel to the sliding direction of the first rack 22.

The detecting assembly 41 includes a shaft 411, a cam 412, and a rocking bar 413 respectively connected to opposite ends of the shaft 411. The opposite ends of the shaft 411 are rotatably connected to the two protruding blocks 33. The cam 412 includes a curved surface 4120 with a gradually decreasing radius. The curved surface 4120 abuts firmly against the slider 42. When the cam 412 is rotated by the shaft 411, the curved surface 4120 urges the slider 42 to slide along the sliding hole 12. The rocking bar 413 includes two rotatable rollers 4130 pressing against the sheets 200 under the force of gravity. When the thickness of the stack of sheets 200 decreases, the rotatable rollers 4130 pressing against the sheets move downward, which causes the shaft 411 to rotate. The cam 42 then urges the slider 42 to slide along the sliding hole 12 and away from the support plate 10.

The second rack 43 includes a second inclined surface 430 at one end, and includes a set of second teeth 432 to engage with the first gear 45 at an opposite end thereof. The slider 42 includes a first inclined surface 420 abutting against the first inclined surface 430. In the embodiment, the resilient member 44 is a coiled spring between the second rack 43 and the stopper block 15, thereby providing a pushing force to the second rack 43. The third rack 46 includes two sets of third teeth 460 on two opposite sides and at opposite ends thereof. The two sets of third teeth 460 engage with the first gear 45 and the second gear 47, and the rotation of the first gear 45 to the second gear 47 is thereby transferred.

When putting the sheets 200 into the input tray 100, the cover 30 is firstly pulled open. The cam 41 disengages from the slider 42, and the resilient member 44 drives the second rack 43 to move away from the stopper block 15, urging the slider 42 to move inward to a position in which the slider 42 disengages from the inclined surface 431 of the second rack 43. The first gear 45 then rotates in a first direction, which causes the third rack 46 to move away from the second rack 43. The second gear 47 rotates in a reverse direction (second direction), which causes the two latching members 20 to move away from each other. Thus, the width between the latching plates 21 becomes greater than that of the sheets 200, which facilitates the placing of the sheets 200.

Figure 3:
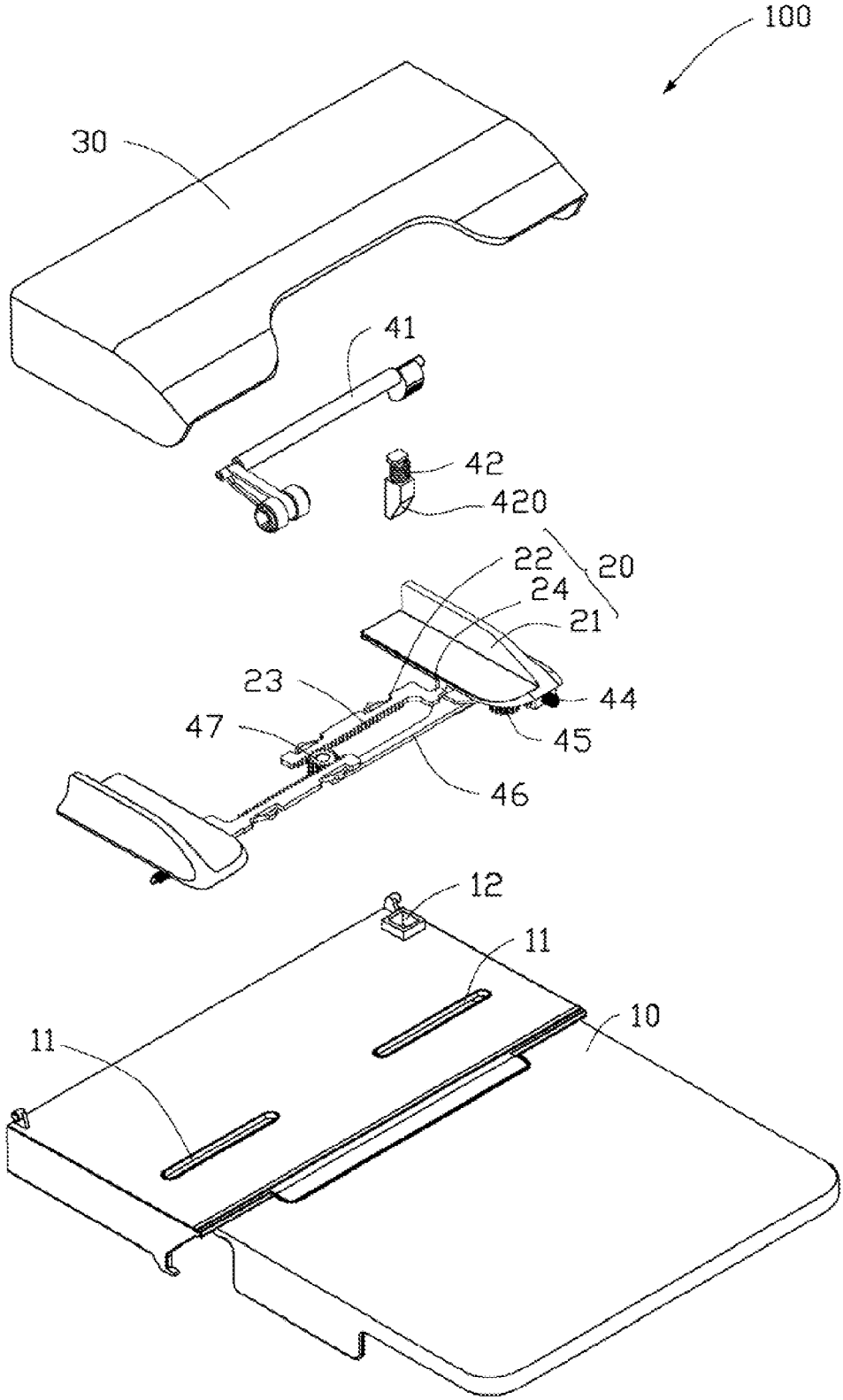
FIG. 3 is an exploded, isometric view of the input tray of FIG. 1.
Figure 4:
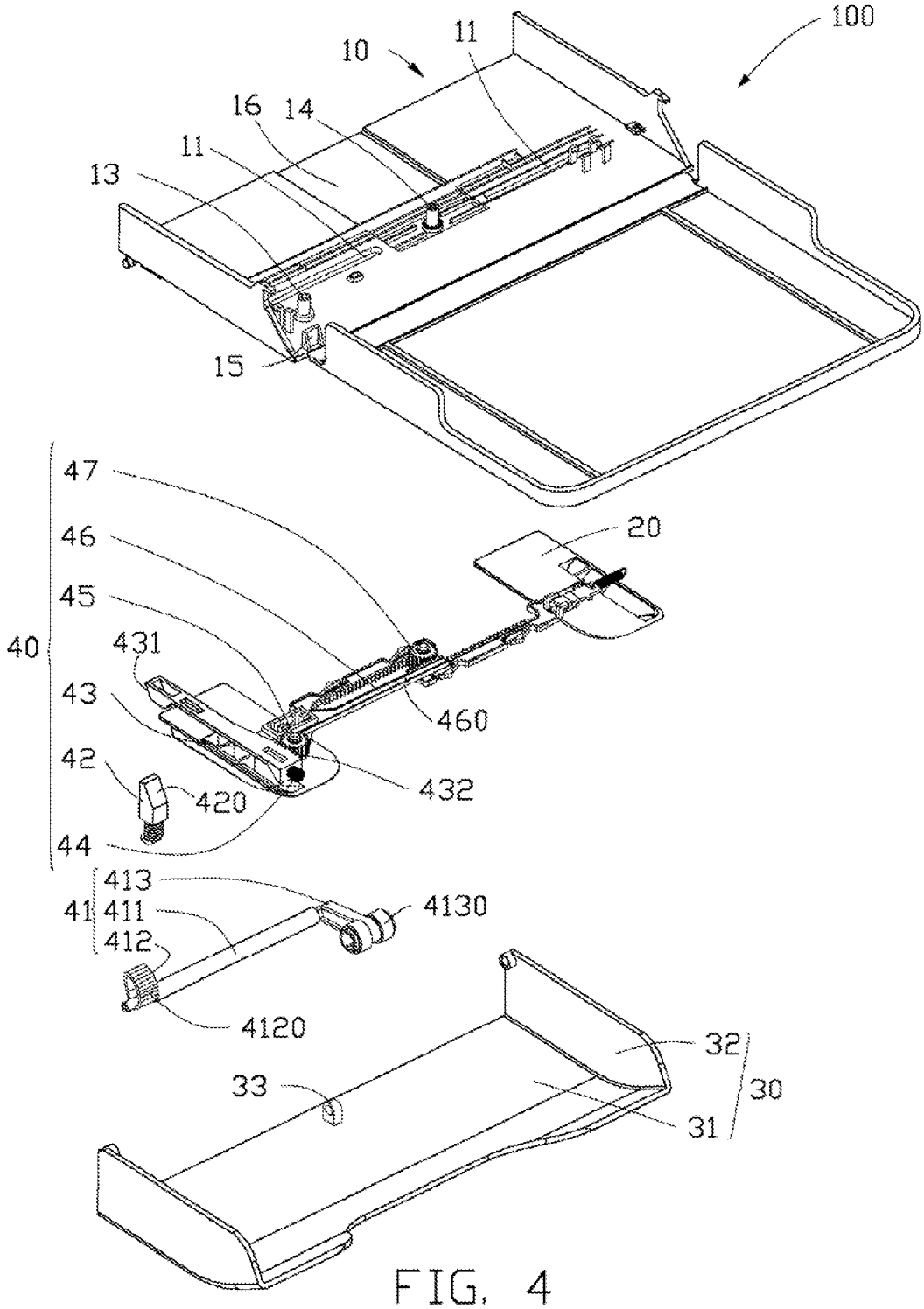
FIG. 4 is similar to FIG. 3, but viewed from the reverse perspective.

After the sheets 200 are placed on the input tray 100, the cover 30 is rotated back to the closed position as shown in FIGS. 1 and 3. The curved surface 4120 of the cam 412 pushes the slider 42 to move outward, and the second rack 43 is urged to move toward the stopper block 15. The first gear 45 is urged to rotate in the second direction, which causes the third rack 46 to move toward the second rack 43. The second gear 47 then rotates in the first direction, which urges the two latching members 20 to move towards each other to a position where the distance between the latching members 20 is slightly less than the width of the sheets 200. Thus, the sheets 200 can be aligned in a neat stack by the two latching plates 21, and the two latching plates 21 cooperatively apply a clamping force F to the sheets 200.

Figure 5:
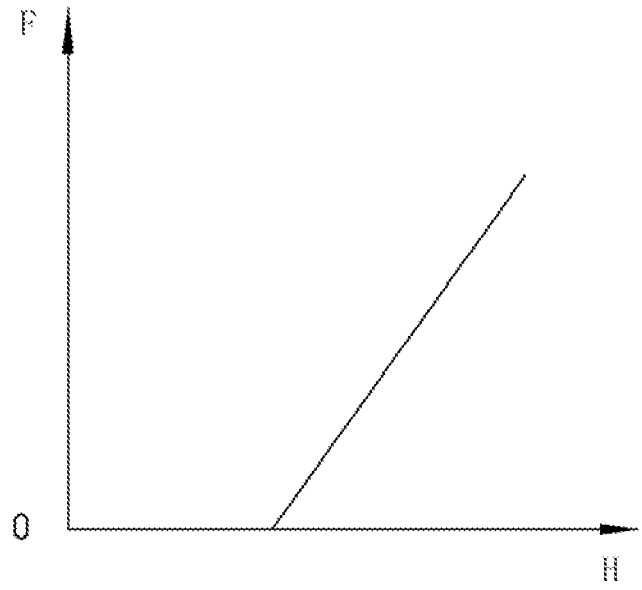
FIG. 5 is a schematic diagram on force analysis and thickness of the paper in the input tray of FIG. 1.

When the thickness of the stack of sheets 200 decreases, the rocking bar 413 gradually rotates the shaft 411. The curved surface 4120 of the cam 412 abutting against the slider 42 gradually moves the slider 42 inwards. The resilient member 44 gradually drives the second rack 43 to move away from the stopper block 15. The first gear 45 and the third rack 46 gradually drive the second gear 47 to rotate in the second direction, causing the two latching members 20 to move away from each other. Thus, the distance between the two latching members 20 increases, causing the clamping force F to gradually decrease (as shown in FIG. 5) as paper is used and the total thickness of the stack of sheets 200 decreases.

While various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. An input tray capable of aligning sheets, comprising:

a support plate for holding the sheets;

two latching members slidably connected to the support plate, and each latching member comprising a latching plate and a first rack comprising a set of first teeth;

a cover rotatably connected to the support plate, wherein the cover is capable of being rotated to a closed position to cover a portion of the support plate and to an open position to be away from the support plate; and a driving mechanism mounted on the support plate for moving the two latching members, the driving mechanism comprising:

a slider slidably connected to the support plate and comprising a first inclined surface;

a second rack slidably connected to a bottom surface of the support plate, wherein the second rack comprises a second inclined surface pressed firmly against the first inclined surface and defines a set of second teeth;

a resilient member applying a pushing force to the second rack;

a first gear rotatably connected to a bottom surface of the support plate and engaging with the second rack and the third rack;

a second gear rotatably connected to the bottom surface of the support plate and engaging with the first teeth of the two latching members; and the third rack slidably connected to the bottom surface of the support plate and comprising a third rack respectively engaged with the first gear and the second gear; wherein when the cover is in the closed position, a distance between the two latching plates is slightly less than a width of the sheets; and when the cover is rotated to the open position, the two latching members are moved away from each other as driven by the driving mechanism, and the distance between the two latching plates becomes greater than the width of the sheets.

2. The input tray as described in claim 1, wherein the support plate defines two sliding slots aligned with each other, and each of the two latching members comprises a connecting portion extending through a corresponding one of the sliding slots.

3. The input tray as described in claim 1, wherein the support plate defines a sliding hole extending therethrough, and the slider is slidably retained within the sliding hole.

4. The input tray as described in claim 1, wherein the bottom surface of the support plate forms a first positioning post and a second positioning post, the first sleeved on the first positioning post, and the second gear is sleeved around the second positioning post.

5. The input tray as described in claim 1, wherein the driving mechanism further comprises a detecting assembly comprising a shaft with two opposite end rotatably connected to the cover, a cam comprising a curved surface with a gradually decreasing curvature radius abutting against the slider, and a rocking bar comprising two rotatable rollers pressing against the sheets under the gravity force.

6. The input tray as described in claim 5, wherein the cover comprises two protruding blocks, and two opposite ends of the shaft are rotatably connected to the two protruding blocks.

7. The input tray as described in claim 1, wherein the bottom surface of the support plate forms a stopper plate, and the resilient member is a coiled spring with two opposite ends respectively connected to the second rack and the stopper block.

8. An input tray capable of aligning a plurality of sheets, comprising:

a support plate for holding the sheets;

two latching members slidably connected to the support plate, and each latching member comprising a latching plate and a first rack comprising a set of first teeth;

a cover rotatably connected to the support plate, wherein the cover is capable of being rotated to a closed position to cover a portion of the support plate and to an open position to be away from the support plate; and a driving mechanism mounted on the support plate for moving the two latching members back and forth, wherein:

when the cover is in the open position, a distance between the two latching plates is greater than a width of the sheets, thereby facilitating the placing of sheets onto the support plate;

when the cover is rotated to the closed position, the two latching members are moved toward each other as driven by the driving mechanism, causing the distance between the two latching plates to become less than the width of the sheet, thereby applying a clamping force to the sheets that are placed on the support plate for aligning the sheets; and when some of the sheets placed on the support plate are removed, causing the thickness of the stack of sheets to decrease, the two latching members are moved away from each other as driven by the driving mechanism, and the distance between the two latching plates increases, causing the clamping force to decrease.

9. The input tray as described in claim 8, wherein the support plate defines two sliding slots aligned with each other, and each of the two latching members comprises a connecting portion extending through a corresponding one of the sliding slots.

10. The input tray as described in claim 8, wherein each latching member comprises a first rack comprising a set of first teeth, and the driving mechanism comprises:

a slider slidably connected to the support plate and comprising a first inclined surface;

a second rack slidably connected to a bottom surface of the support plate, wherein the second rack comprises a second inclined surface pressed firmly against the first inclined surface and defines a set of second teeth;

a resilient member applying a pushing force to the second rack;

a first gear rotatably connected to a bottom surface of the support plate and engaging with the second rack portion and the third rack portion;

a second gear rotatably connected to the bottom surface of the support plate and engaging with the first teeth of the two latching members;

a third rack slidably connected to the bottom surface of the support plate and comprising a third rack respectively engaged with the first gear and the second gear; and a detecting assembly comprising a shaft with two opposite end rotatably connected to the cover, a cam comprising a curved surface with a gradually decreasing curvature radius abutting against the slider, and a rocking bar comprising two rotatable rollers pressing against the sheets under the gravity force.

11. The input tray as described in claim 10, wherein the support plate defines a sliding hole extending therethrough, and the slider is slidably retained within the sliding hole.

12. The input tray as described in claim 10, wherein the bottom surface of the support plate forms a first positioning post and a second positioning post, the first sleeved on the first positioning post, and the second gear is sleeved on around the second positioning post.

13. The input tray as described in claim 10, wherein the cover comprises two protruding blocks, and two opposite ends of the shaft are rotatably connected to the two protruding blocks.

14. The input tray as described in claim 10, wherein the bottom surface of the support plate forms a stopper plate, and the resilient member is a coiled spring with opposite ends connected to the second rack and the stopper block.

* * * * *